US005740645A

United States Patent [19]

Raby

[11] Patent Number: 5,740,645

[45] Date of Patent: Apr. 21, 1998

[54] J-BOLT FORM

[76] Inventor: David Michael Raby, 8202 Briargate, San Antonio, Tex. 78230-5006

[21] Appl. No.: 780,586

[22] Filed: Jan. 8, 1997

[51] Int. Cl.[6] ..... E02D 27/00

[52] U.S. Cl. ..... 52/297; 52/294; 52/651.07; 248/346.5

[58] Field of Search ..... 52/294, 295, 296, 52/297, 745.21, 698, 712, 745.17, 745.18, 651.07; 248/346.5, 519, 530

[56] References Cited

U.S. PATENT DOCUMENTS

| | | | |
|---|---|---|---|
| 1,333,523 | 3/1920 | Williams, Jr. | 52/295 |
| 4,590,719 | 5/1986 | McKibbin | 52/745.18 X |
| 5,016,338 | 5/1991 | Rowan, Jr. | 52/745.21 |
| 5,121,594 | 6/1992 | Wuertz | 52/745.21 |
| 5,327,696 | 7/1994 | McBride | 52/745.21 |
| 5,337,534 | 8/1994 | Nasca | 52/745.21 |
| 5,501,048 | 3/1996 | Nakanishi | 52/296 |

FOREIGN PATENT DOCUMENTS

| | | | |
|---|---|---|---|
| 800509 | of 1950 | Germany | 52/297 |

*Primary Examiner*—Creighton Smith
*Attorney, Agent, or Firm*—Patent & Trademark Services; Joseph H. McGlynn

[57] ABSTRACT

An improved device for supporting and aligning anchor bolts within a light pole foundation mold. An outer ring having a downwardly projecting, circumferential lip fits atop a sonotube foundation mold. Cross members transverse the space inside the ring and have holes disposed thereon for receiving bolts. A conduit receiving hole is positioned at the intersection of the cross members. Projections on the top side of the outer ring have an outer edge that is aligned with the inner edge of the circumferential lip to provide means for securely stacking several of the devices in superimposed fashion.

3 Claims, 1 Drawing Sheet

J-BOLT FORM

BACKGROUND OF THE INVENTION

The present invention relates generally to devices which facilitate the alignment or placement of bolts, and in particular to a form having means to support and properly align bolts in a concrete mold for mounting a light pole or other item thereon.

DESCRIPTION OF THE PRIOR ART

In the construction industry, a common means of anchoring items to a concrete foundation is to place upwardly protruding bolts in the concrete mold before the concrete is poured. When the concrete hardens, the bolts provide a stable and convenient anchoring device. A common problem encountered with this process, however, is that the bolts tend to become wrongly positioned or misaligned. This is a common problem, especially in the construction of foundations for light pole fixtures. Light pole foundations are most often formed by pouring wet concrete into a cylindrical mold embedded in the ground. Bolts embedded into the concrete serve as attachment means for the base of the pole. A number of devices have been developed in the prior art to place bolts in proper positioning for anchoring in various types of construction projects. However, as described below, the prior art devices are clearly unsuited for the task of securing bolts in the proper alignment within light pole foundation molds.

U.S. Pat. No. 5,337,534 describes a foundation bolt holder having grasping means for straddling a foundation form and for holding a bolt. This invention is undesirable for setting bolts in a light pole foundation, since a number of the devices must be used to place multiple bolts, as is required to anchor light pole fixtures. Moreover, the device is unsuitable for the circular molds commonly used for light poles, since the straddling device is designed for grasping rectilinear boards.

U.S. Pat. Nos. 5,327,696 and 5,016,338 describe methods for anchoring devices to concrete using bolt-type anchors. These methods are unsuitable for anchoring a light pole fixture, as they do not provide means to align the bolts in a wet concrete mold, as is commonly done in the construction of light pole foundations.

U.S. Pat. No. 5,121,594 describes a method for attaching a poke-through electrical fitting, comprising a template for marking the locations of mounting holes. This invention, as well, is designed for anchoring items to hardened concrete, and therefore cannot be used to place bolts in a wet concrete mold.

Clearly, there remains a need for a device which can be used to support and properly align bolts in a concrete mold for anchoring a light pole. In addition, there remains a need for a bolt placement device which is easy to use, reusable, and adaptable to differently sized foundations.

SUMMARY OF THE INVENTION

The present invention, described in detail below, provides a convenient, inexpensive, and reusable means to properly align and support bolt attachments within light pole foundation molds. The invention comprises an outer ring which can be constructed in various dimensions to fit atop differently sized light pole foundation molds. A circumferential lip extends downward from the outer ring to prevent lateral travel of the outer ring when mounted atop a foundation mold. Cross members extending between opposing ends of the outer ring have a plurality of variously sized holes disposed thereon for receiving bolts. At the intersection of the cross members is an opening for the passage of an electrical conduit for supplying power to the light pole fixture. Corresponding indentations and notches on the outer ring provide a means to stack several of the bolt holders superimposedly for secure storage.

The invention provides a means to place anchor bolts in the proper alignment for all types of electrical pole foundations. The device eliminates the need to fashion makeshift apparatuses to position bolts within a mold, as is commonly done. The invention is durably constructed from inexpensive materials, and can be removed and stored easily.

Accordingly, it is an object of this invention to provide an improved device for placing and aligning bolt attachments in a concrete mold.

It is a further object of this invention to provide an improved bolt placing device for concrete molds that is inexpensive, convenient, and easily stored.

It is still further an object of this invention to provide an improved bolt placing device for concrete foundations of light pole fixtures.

These and other objects and advantages will become apparent from the detailed description below, when taken in conjunction with the annexed drawings.

DESCRIPTION OF THE PREFERRED EMBODIMENT

Figure 1:
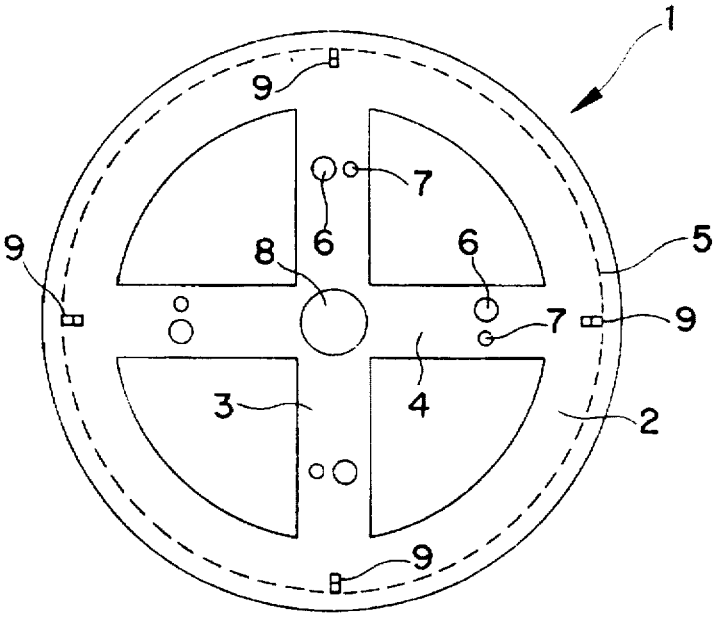
FIG. 1 shows a top view of the present invention.

Referring now to the drawings in greater detail, the bolt alignment and support device 1 can be seen in FIG. 1 comprising an outer ring 2 having cross members 3, 4 transversing the space inside the ring 2. Outer ring 2 and cross members 3, 4 may be constructed from plastic, wood, or any other durable, inexpensive material, though plastic is preferable. Bolt-receiving holes 6, 7 are disposed on the cross members 3, 4, and a conduit-receiving hole 8 is positioned at the intersection of the cross members 3, 4. As shown best in FIGS. 2 and 3, a circumferential lip 5 extends downward from the outer ring 2.

Figure 3:
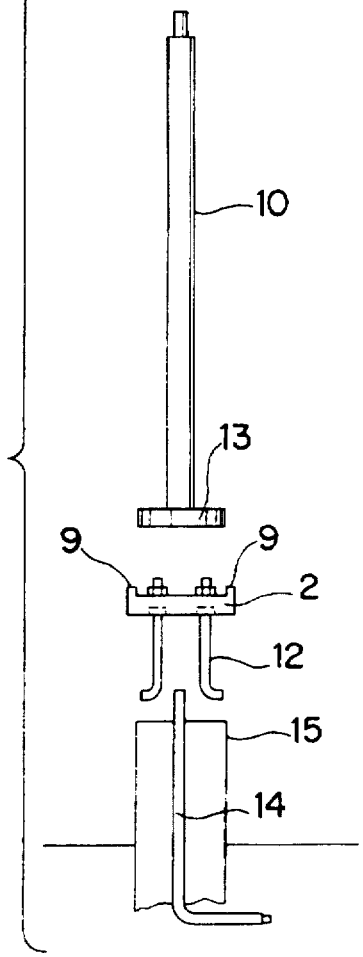
FIG. 3 shows an exploded, side elevational view of the present invention as used in conjunction with a light pole fixture and the foundation thereof.
Figure 2:
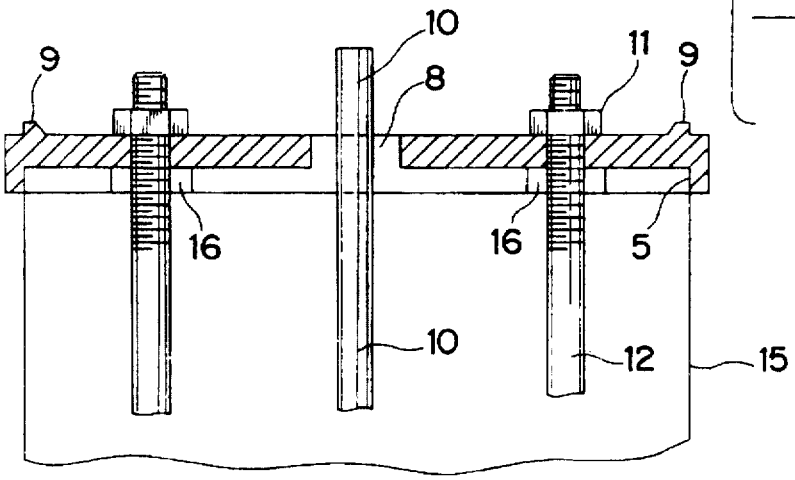
FIG. 2 shows a side view of the present invention installed atop a light pole foundation mold.

The use and application of the present invention 1 are best illustrated in FIGS. 2 and 3, wherein it may be seen that the outer ring 2 is positioned atop a light pole foundation mold, known in the art as a sonotube 15, which is embedded into a ground hole. The sonotube 15 is a rigid paper tubing, forming a mold into which wet concrete is poured to form a foundation for a light pole 10. Light pole 10 has a flanged base 13 with holes for receiving bolt anchors 12. The upper edge of the sonotube 15 is received into the circumferential lip 5 as shown in FIG. 3. Bolts 12 are inserted into bolt receiving holes 6, 7, and nuts 11 are positioned on the bolts 12 on either side of the cross members 3, 4. Electrical conduit 14, providing current to the light pole fixture 10, is received through the conduit hole 8.

Spaces between cross members 3, 4 provide openings into which concrete is poured to fill the sonotube 15. Concrete is poured to a level slightly below the nut 16 on the underside of the bolt alignment and support device 1. Circumferential lip 5 prevents lateral movement of the bolt alignment and support device 1 during the pouring process, holding it securely atop the sonotube 15. Bolts 12 are held at the precise alignment and position in the bolt receiving holes 6, 7 as concrete hardens, thus providing a secure anchor for the light pole fixture 10, as may be seen in FIG. 3. After the concrete has hardened, the nuts 11 are taken off and the bolt alignment and support device may be removed and reused.

As shown in FIGS. 1 and 2, the outer ring 2 further has projections 9 extending from the upper surface thereof. Projections 9 have an outer edge aligned with the inner edge of the circumferential lip 5. The projections 9 provide means to stack securely several of the bolt alignment and support devices 1 in superimposed fashion during storage with the projection 9 on one ring fitting into the circumferential lip 5 on a second ring. The projections 9 on one outer ring 2 are received into the circumferential lip 5 of that directly above, providing an interlocking arrangement which prevents lateral movement and allows the bolt alignment and support devices 1 to be stacked.

The bolt alignment and support device 1 can be constructed in various dimensions to accommodate different types of light pole fixtures L without departing from the scope of the invention. In addition, the dimension and placement of the bolt receiving holes 6, 7 can vary to fit bolt specifications of particular light poles. The size of the holes 6,7 are of a different size to receive different size bolts.

Although the bolt support and alignment device and the method of using the same according to the present invention has been described in the foregoing specification with considerable details, it is to be understood that modifications may be made to the present invention which do not exceed the scope of the appended claims and modified forms of this invention done by others skilled in the art to which the invention pertains will be considered infringements of this invention when those modified forms fall within the claimed scope of the invention.

What I claim as my invention is:

1. A support for attaching J-bolts to a concrete base for a light pole, said support comprising:

a base plate having an outer dimension and an inner dimension, and a top and a bottom surface, at least two cross members extending from a center of said base plate to said inner dimension, said cross members having a plurality of apertures therethrough, said base plate having a central aperture extending therethrough, said base plate having a recess in said bottom surface formed by a wall projecting downward from said base plate, said base plate having a plurality of projections on said top surface.

2. The support for attaching J-bolts to a concrete base for a light pole as claimed in claim 1, wherein said plurality of apertures in said cross members are at least two different sizes.

3. The support for attaching J-bolts to a concrete base for a light pole as claimed in claim 1, wherein said plurality of projections have an inner wall and an outer wall, said outer wall being in alignment with said recess.

* * * * *